US010267340B2

(12) United States Patent
Barron et al.

(10) Patent No.: US 10,267,340 B2
(45) Date of Patent: Apr. 23, 2019

(54) CONCENTRICALLY SYMMETRIC CONNECTOR IN BLIND MATE ROUND FAN ASSEMBLY

(71) Applicant: International Business Machines Corporation, Armonk, NY (US)

(72) Inventors: David Barron, Austin, TX (US); Rachael C. Freitas, Austin, TX (US); Howard V. Mahaney, Jr., Cedar Park, TX (US); Benjamin W. Mashak, Rochester, MN (US); George Zacharakis-Jutz, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 481 days.

(21) Appl. No.: 15/052,200

(22) Filed: Feb. 24, 2016

(65) Prior Publication Data

US 2017/0241440 A1 Aug. 24, 2017

(51) Int. Cl.

| | |
|---|---|
| ***F04D 19/00*** | (2006.01) |
| ***F04D 25/16*** | (2006.01) |
| ***F04D 29/64*** | (2006.01) |
| ***F04D 29/32*** | (2006.01) |
| ***F04D 29/52*** | (2006.01) |
| ***F04D 29/70*** | (2006.01) |
| ***H05K 9/00*** | (2006.01) |
| ***F04D 29/60*** | (2006.01) |

(52) U.S. Cl.

CPC ..... *F04D 29/703* (2013.01); *F04D 19/002* (2013.01); *F04D 25/166* (2013.01); *F04D 29/601* (2013.01)

(58) Field of Classification Search

CPC .... F04D 19/002; F04D 25/166; F04D 29/325; F04D 29/522; F04D 29/644; F04D 29/703; H05K 9/0015

See application file for complete search history.

(56) References Cited

U.S. PATENT DOCUMENTS

| | | | | |
|---|---|---|---|---|
| 2,538,196 | A * | 1/1951 | Hildebrand | F04D 25/064 310/66 |
| D283,156 | S * | 3/1986 | Mandelli | D12/214 |
| 5,816,673 | A | 10/1998 | Sauer et al. | |
| 6,749,398 | B2 | 6/2004 | Lu et al. | |
| 6,813,152 | B2 | 11/2004 | Perazzo | |
| 7,244,178 | B2 | 7/2007 | Ueda et al. | |

(Continued)

FOREIGN PATENT DOCUMENTS

| | | |
|---|---|---|
| EP | 1408238 A2 | 4/2004 |

*Primary Examiner* — Igor Kershteyn

(74) *Attorney, Agent, or Firm* — Patterson + Sheridan, LLP

(57) ABSTRACT

A fan assembly system includes two or more circular fans, each fan situated in a round fan assembly, where each fan can be situated in the round fan assembly in any orientation. The system also includes a concentrically symmetric connector for each circular fan, located in a center of each circular fan. The system also includes a latching mechanism for each circular fan, where the latching mechanism is wholly contained within a swept area of a fan blade of the circular fan. The circular fans are arranged in a staggered arrangement, and the staggered arrangement of circular fans increases a number of circular fans that can be placed in the fan assembly system compared to a non-staggered arrangement.

20 Claims, 5 Drawing Sheets

(56) References Cited

U.S. PATENT DOCUMENTS

| | | | | |
|---|---|---|---|---|
| 7,381,129 | B2 * | 6/2008 | Avedon | F04D 25/088 416/247 R |
| 7,589,966 | B2 | 9/2009 | Ong et al. | |
| 7,729,116 | B1 | 6/2010 | Aybay et al. | |
| D630,312 | S * | 1/2011 | Spaulding | D23/377 |
| D715,420 | S * | 10/2014 | Funston | D23/382 |
| 2006/0203446 | A1 | 9/2006 | Radhakrishnan et al. | |
| 2012/0136978 | A1 | 5/2012 | Lou et al. | |
| 2014/0099195 | A1 * | 4/2014 | Jun | F04D 25/0613 415/182.1 |

* cited by examiner

CONCENTRICALLY SYMMETRIC CONNECTOR IN BLIND MATE ROUND FAN ASSEMBLY

BACKGROUND

The present disclosure relates to a method for packaging an electronic cooling fan, and more particularly to using a concentrically symmetric connector in a round fan assembly.

In the packaging of modern fans to cool electronic components, round fans are molded into square fan assemblies. The square packaging takes up unnecessary areas in the corners of the cage surrounding the fan due to placing a circular fan in a square assembly. A round fan assembly takes up about 78% of the space of a square assembly.

Another issue with current fan packaging is the placement of the connector. A typical electronic cooling fan requires two to five pins on a connector per rotor, which must be connected into the rest of the system. One method of making these connections is with a blind mate connector; the whole fan assembly docks and makes the electrical connections in one operation. For a hot-swappable fan out of the front or rear of the electronic chassis, the connector must either live within the swept area of the rotor (which impedes the airflow) or outside the swept area of the rotor (which consumes extra area on the chassis that could be used for more components). In either scenario, the wires coming from the center of the fan must traverse from, and cover at least a portion of, the swept area of the fan.

Another issue with current fan packaging is that a hot-swappable fan out of the front or back must be inserted in a specific orientation to dock the connector. As one example, a connector may reside in a corner of the fan assembly, and that corner must be lined up to dock. To prevent the fan assembly from being inserted in the wrong direction, the design engineer must incorporate physical stops into the mating assembly or fan assembly to ensure proper installation.

Another issue associated with current fan assembly connectors is that the connector must typically be retained with a cage. The connectors are typically "panel mount;" they attach to a sheet of material or are retained to a fan cage so that they may be aligned with the receptacle.

SUMMARY

According to one embodiment, a fan assembly system includes two or more circular fans, each fan situated in a round fan assembly, where each fan can be situated in the round fan assembly in any orientation. The system also includes a concentrically symmetric connector for each circular fan, located in a center of each circular fan. The system also includes a latching mechanism for each circular fan, where the latching mechanism is wholly contained within a swept area of a fan blade of the circular fan. The circular fans are arranged in a staggered arrangement, and the staggered arrangement of circular fans increases a number of circular fans that can be placed in the fan assembly system compared to a non-staggered arrangement.

According to another embodiment, a fan assembly system includes two or more circular fans, each fan situated in a round fan assembly. The system also includes a concentrically symmetric connector for each fan, wherein the concentrically symmetric connector is located in a center of each circular fan. The fans are arranged in a staggered arrangement.

According to yet another embodiment, a method of packaging a cooling fan assembly includes inserting a round fan assembly into one of one or more round openings of an enclosure, where the round openings are arranged in a staggered arrangement. The method further includes applying insertion force to mate a concentrically symmetric connector at a center of the round fan assembly.

BRIEF DESCRIPTION OF THE SEVERAL VIEWS OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

For clarity, identical reference numerals have been used, where applicable, to designate identical elements that are common between figures. Additionally, elements of one embodiment may be adapted for use with other embodiments.

DETAILED DESCRIPTION

Embodiments described herein provide for a concentrically symmetric connector placed in the center of the fan. The concentrically symmetric connector may be an audio connector, commonly known as an audio jack. Other names include a phone connector, phone plug, stereo plug, or stereo jack. For simplicity, the terms audio plug and audio jack are used in this disclosure. A concentrically symmetric connector allows for the fan assembly to be round and for the corner areas in the existing square assemblies to be utilized. A round fan assembly also allows for insertion in any orientation. A sheet metal grill may be overmolded with a fan case to prevent finger insertion into the fan blades as well as to provide electromagnetic interference (EMI) protection when combined with an EMI gasket. The fan case may be made of plastic in certain embodiments. The overall internals of the fan assembly may be largely unchanged from an industry standard electronics cooling fan. A round circuit board may sit in the middle of the fan. The circuit board may receive and/or provide instructions that control the operation of the fan. The blades may incorporate bearings attached to the fan case to ensure balanced rotation.

Embodiments described herein may also provide another improvement over current systems. Square or rectangular fan assemblies are populated in a grid pattern along the front or back of a system. Round fan assemblies in these embodiments eliminate the need for a cage, and therefore the fans may be packed in a denser fan arrangement. The fans may be staggered, with alternating fans offset from the centerline upwards and other fans offset downwards, such that the fans may be positioned closer together and more fans may be populated within a given area. Another possible improvement is to stagger the fans in one plane with another identical but offset plane of staggered fans in series with the first. The area saved by using round fan housings instead of square or rectangular allows for the second set of fans to operate at a lower impedance levels and therefore higher net airflow.

Figure 1:
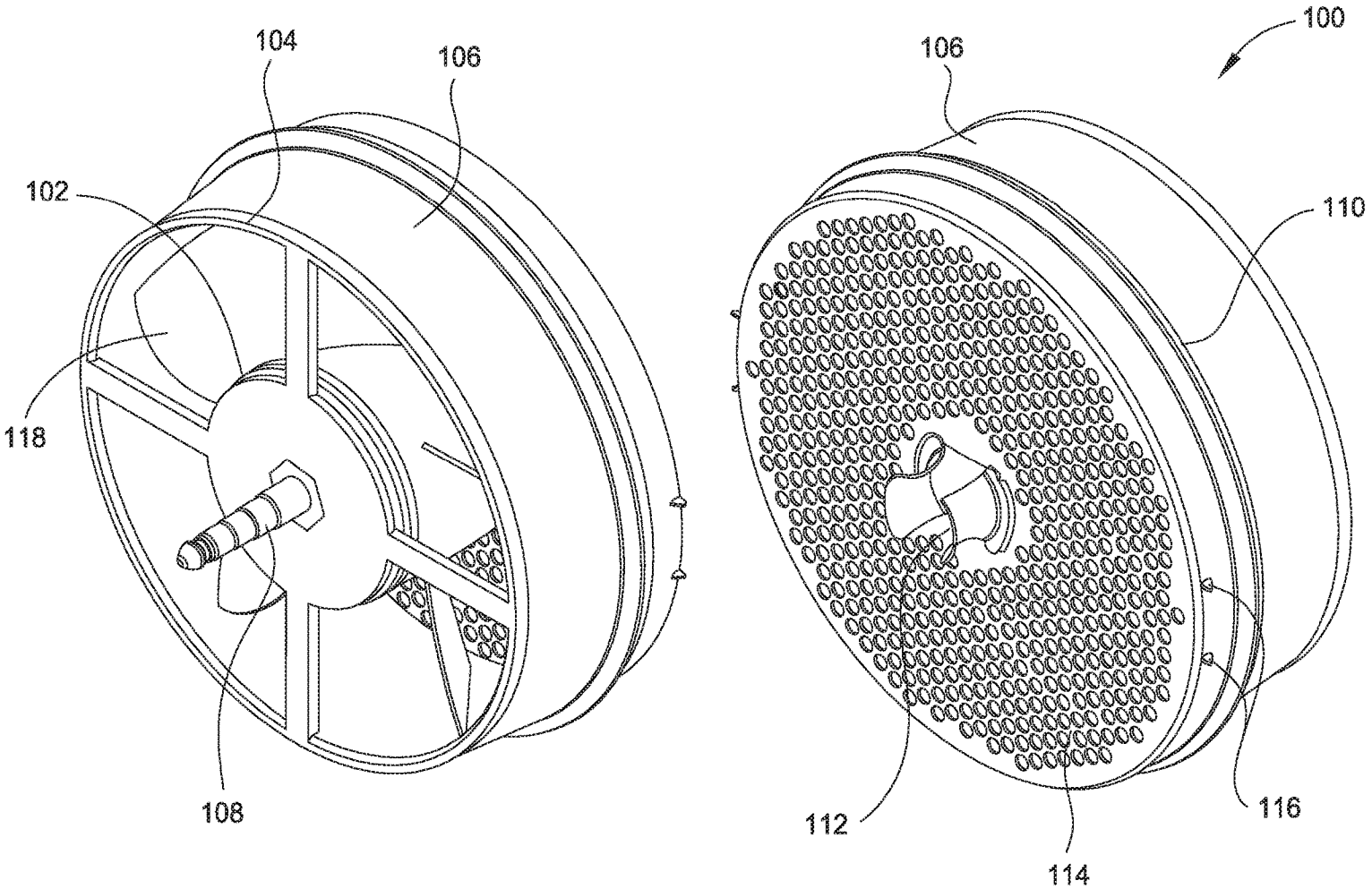
FIG. 1 illustrates two different views of a fan assembly, according to one embodiment disclosed herein.

FIG. 1 illustrates two different views 100 of a fan assembly according to one embodiment of the present disclosure. The left side comprises a back view of a fan assembly and the right side comprises a front view. The fan assembly comprises a concentrically symmetric connector 108 situated in the center of the fan assembly and visible on the left side of FIG. 1. The concentrically symmetric connector 108 may comprise an audio plug. The connector 108 that is illustrated is a male connector that has four circuits, but any suitable connector with any number of circuits may be used. As one example, quarter-inch audio plugs and jacks generally have from two to six circuits and can handle up to 10 Amperes per pin. These types of plugs typically have two, three or four contacts. Three-contact versions are known as TRS connectors, where T stands for "tip," R stands for "ring," and S stands for "sleeve." Two- and four-contact versions are called TS and TRRS connectors respectively. In other embodiments, a female concentrically symmetric connector may be utilized, as described in further detail below with respect to FIG. 2.

Circuit board 102 is also illustrated on the left side of FIG. 1. Circuit board 102 is round in this embodiment and sits in the middle of the fan. Fan blades 118 are also illustrated on the left side of FIG. 1, and can be seen through sheet metal grill 114 on the right side of FIG. 1. Fan guard 104 is also illustrated on the left side. Fan case 106 can be seen on both sides of FIG. 1. As mentioned above, fan case 106 may be overmolded over the sheet metal grill 114.

EMI gasket 110 is shown on the right side of FIG. 1. Sheet metal grill 114 in combination with EMI gasket 110 provides EMI protection. The right side of FIG. 1 also illustrates retention touch points 112 and retention latch hooks 116. In this embodiment, there are two latches that sit in front of the fan and have retention touch points 112 that extend through the fan case and are forced to the outside of the fan case with springs (not shown). When the retention touch points 112 are pinched together, the touch points 112 retract into the fan case and the fan can be removed. The latching mechanism will be discussed in further detail below.

Figure 2:
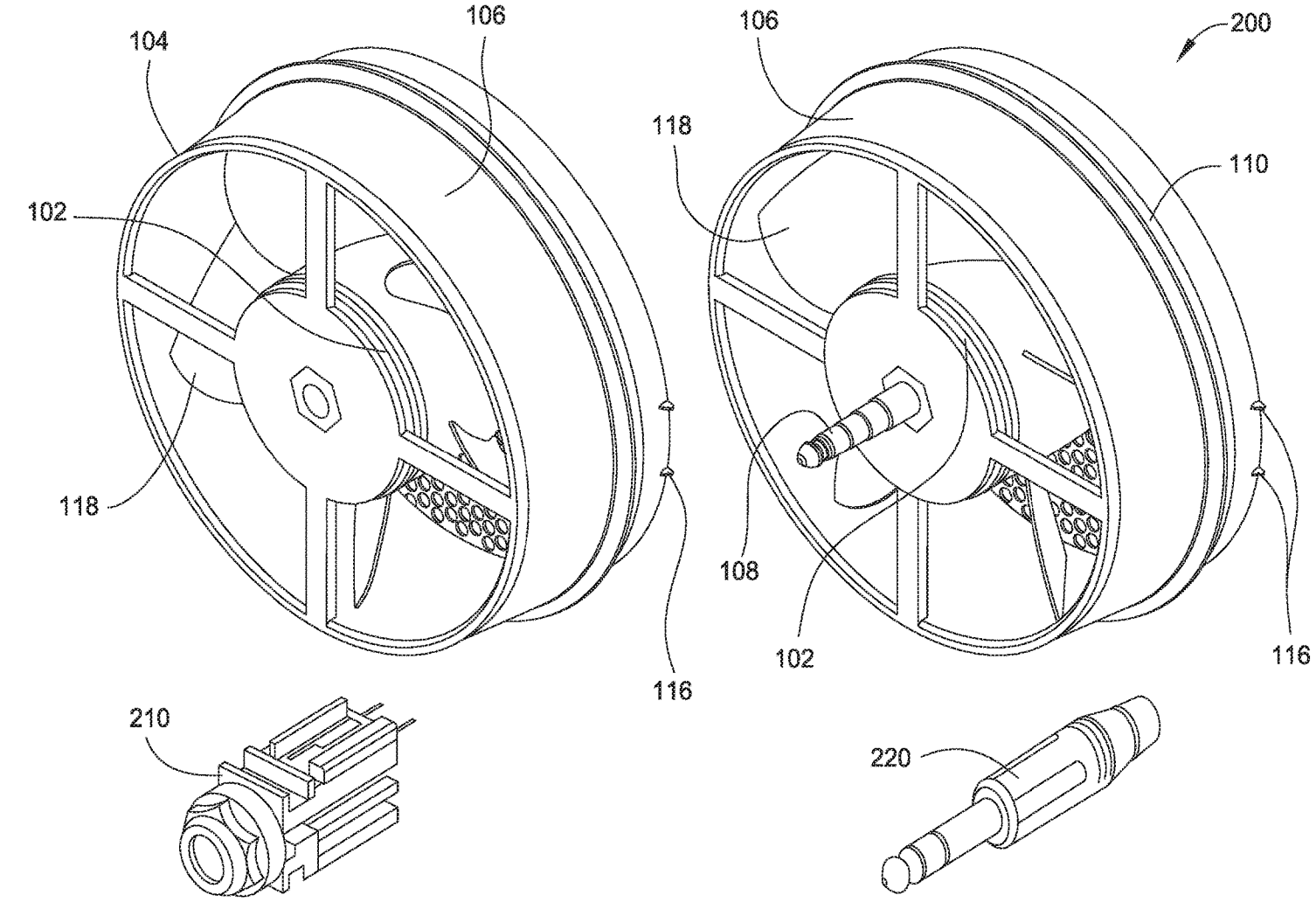
FIG. 2 illustrates a fan assembly with female and male connectors, according to one embodiment disclosed herein.

FIG. 2 illustrates two views of a fan assembly 200 with female and male connectors, according to one embodiment disclosed herein. Many of the components discussed above with respect to FIG. 1 are also illustrated in FIG. 2; like numbers denote like components. As illustrated on the left side of FIG. 2, a female concentrically symmetric connector 210 is located in the center of the fan. The female connector 210 is also illustrated in full below the fan. In this embodiment, the fan can be inserted into an enclosure, with the center female connector coupling to a male connector. As seen in this embodiment, the shape of the concentrically symmetric connector 210 and the location of the connector 210 in the middle of the fan ensures that the fan can be inserted in any orientation. In contrast, square or rectangular fan assemblies generally have a connector in a corner of the fan assembly. This corner must be aligned so that the connector can dock, and therefore the rectangular fan assembly can be inserted in only one orientation.

The right side of FIG. 2 illustrates a male concentrically symmetric connector 220. The male connector can be seen protruding from the fan in the upper right side of FIG. 2. In this embodiment, the fan can be inserted into an enclosure, with the center male connector coupling to a female connector. The shape and location of the concentrically symmetric connector 220 ensures that the fan can be inserted in any orientation.

Figure 3:
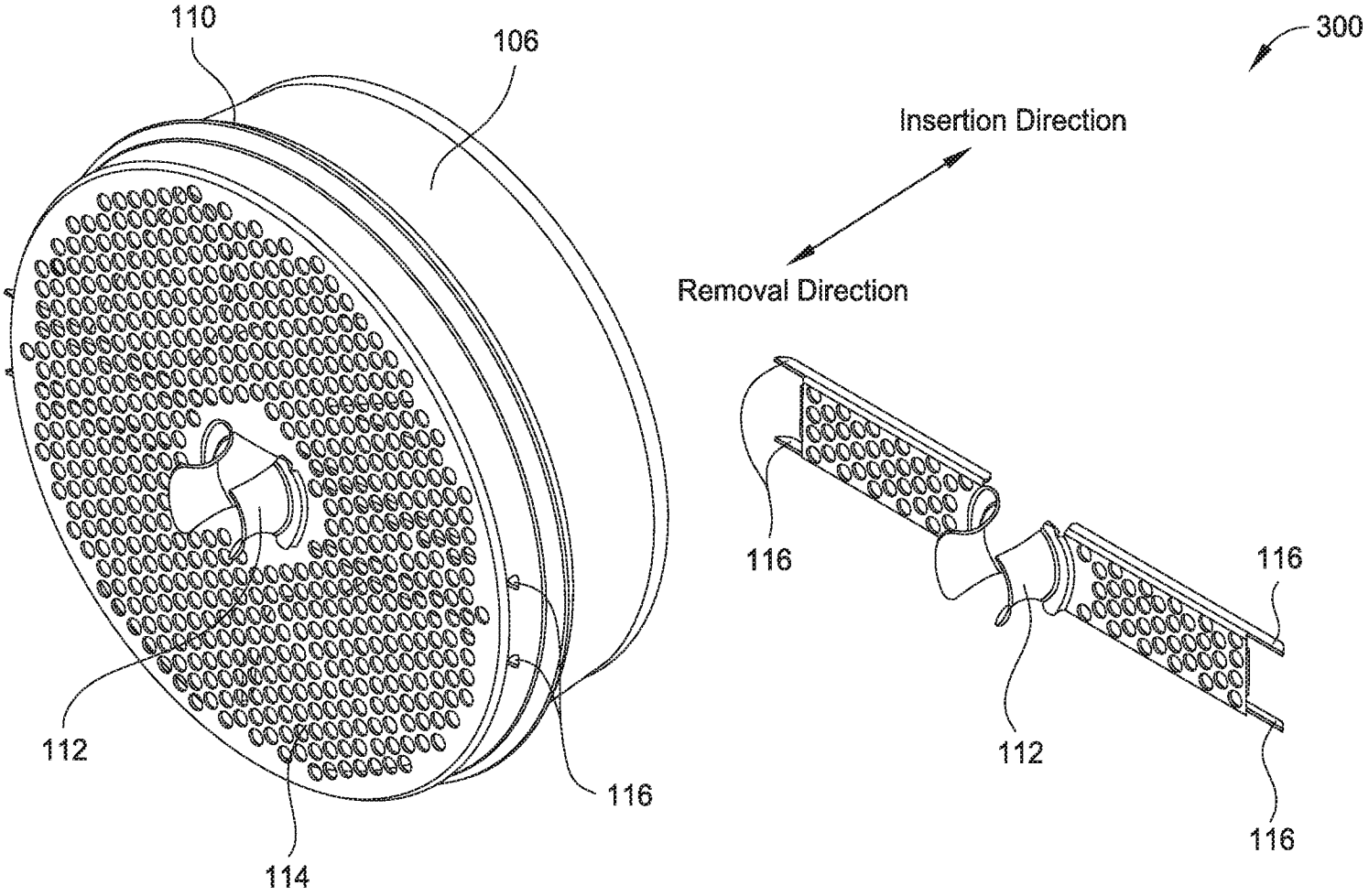
FIG. 3 illustrates a latching scheme for a round fan assembly, according to one embodiment disclosed herein.

FIG. 3 illustrates a latching scheme 300 for a round fan assembly, according to one embodiment disclosed herein. Many of the components discussed above with respect to FIGS. 1 and 2 are also illustrated in FIG. 3; like numbers denote like components. The removal direction and insertion direction are illustrated with an arrow at the top of the figure. The left side of FIG. 3 illustrates the prongs (retention touch points 112) of the latching mechanism protruding through the sheet metal grill 114 of the fan case. These retention touch points 112 can also be seen on the right side of FIG. 3. When the touch points 112 are pinched, they retract into the fan case and the fan can be removed. In this example design, the fan can be inserted without requiring the touch points 112 to be pinched together.

Retention latch hooks 116 can also be seen in further detail on the right side of FIG. 3. Two hooks 116 are illustrated on each side of the latch. In addition, the perforations on the latch can be designed to line up with the perforations on the fan grill to reduce the impedance associated with placing the latches in the swept area of the fan.

Figure 4:
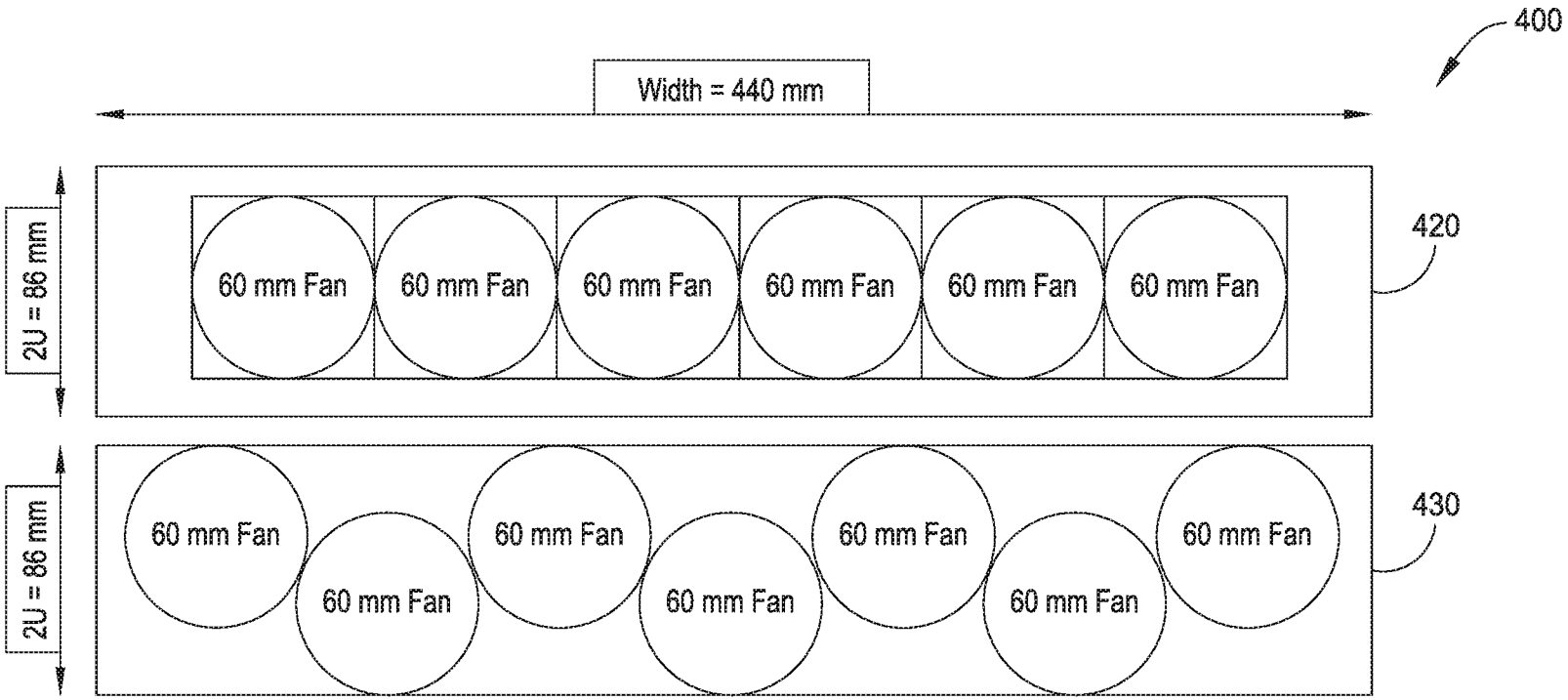
FIG. 4 illustrates an example fan packing structure, according to one embodiment disclosed herein.

FIG. 4 illustrates an example fan packing structure, according to one embodiment disclosed herein. As described above, a center connector in the fan structure allows more fans to be packed into a given area than the traditional square or rectangular fan assemblies. Two structures are shown in schematic 400 (structures 420 and 430). Each structure is outlined with a box representing the frontal area of a 2U server at 86 mm tall and 440 mm wide. With a square cage, the width equals the height, which also equals the fan diameter plus about 3 mm. With a round fan assembly, the diameter of the fan assembly equals the fan diameter plus about 3 mm. These measurements can be used to determine the fan packing density for the various fan assemblies.

The top structure 420 illustrates the maximum packing density of 60 mm fans in the described frontal area. Note that the width of the structure is slightly too small to fit a seventh 60 mm fan.

Structure 430, illustrated at the bottom of FIG. 4, shows how round 60 mm fans fit within a frontal area that is 86 mm tall and 440 mm wide. If the traditional square boundary is replaced by the round outline enabled by this disclosure, the fans may be staggered as shown and a seventh fan fits into the frontal area. As shown, alternating fans are offset from the centerline upwards and the other fans are offset from the centerline downwards.

In other embodiments, different fan sizes may be used for a specific configuration. For example, a 40 mm fan may be able to fit into the interstitial voids of four 120 mm fans that are created by removing the square assemblies around the 120 mm fans. The concentrically symmetric centered connector enables this option by eliminating the fan cage and retrieving space that is otherwise wasted.

Figure 5:
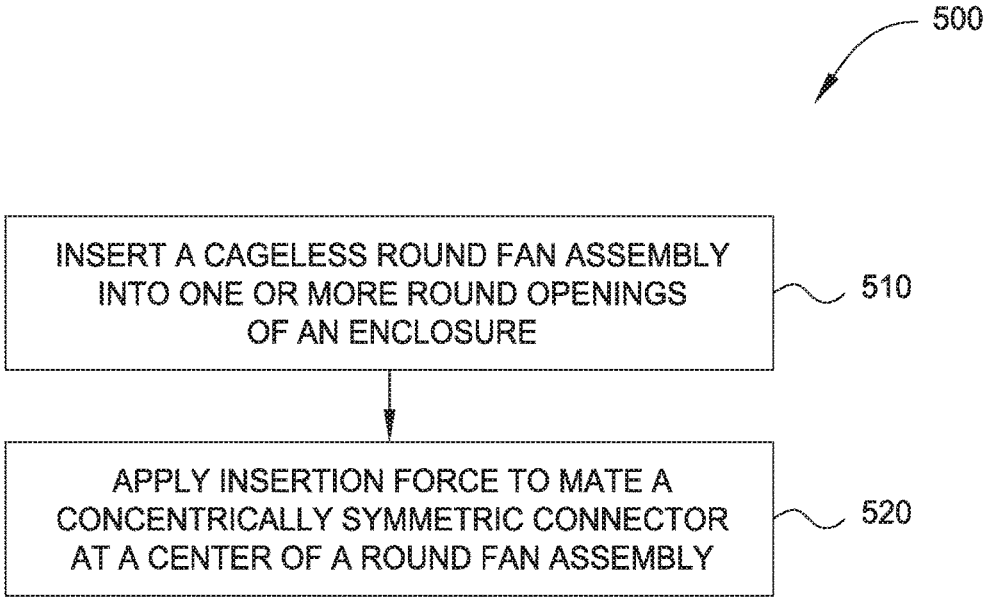
FIG. 5 illustrates a flowchart of a method for packaging a cooling fan assembly, according to one embodiment disclosed herein.

FIG. 5 is a flowchart of a method 500 for packaging a cooling fan assembly. Although the method steps are described in conjunction with the systems of FIGS. 1-4, persons skilled in the art will understand that any system configured to perform the method steps, in any order, falls within the scope of the present invention. In various embodiments, the hardware and/or software elements described above in FIGS. 1-4 can be configured to perform the method steps of FIG. 5.

The method 500 begins at step 510 where a user inserts a round fan assembly into one of one or more round openings of an enclosure. The round openings are arranged in a staggered arrangement as illustrated in FIG. 4 above. The staggered arrangement increases a swept area of a chassis area compared to a non-staggered arrangement. At step 520, the user applies insertion force to mate a concentrically symmetric connector at a center of the round fan assembly. Inserting the round fan assembly comprises inserting the round fan assembly in any orientation.

In some embodiments, the concentrically symmetric connector mates with an audio jack. In other embodiments, the concentrically symmetric connector mates with an audio plug. In some embodiments, the round fan assembly is latched with a latching mechanism wholly contained within a swept area of a fan blade. One example latching mechanism is illustrated above in FIG. 3. One or more latch pieces of the latching mechanism may be perforated to reduce impedance to air flow of the fan blade.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application, or technical improvement over technologies found in the marketplace, or to enable others of ordinary skill in the art to understand the embodiments disclosed herein.

As will be appreciated by one skilled in the art, aspects of the present invention may be embodied as a system, method, or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers, and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. A fan assembly system, comprising:

two or more circular fans, each fan situated in a round fan assembly;

a concentrically symmetric connector for each fan, wherein the concentrically symmetric connector is located in a center of each circular fan, wherein a plurality of contacting surfaces of the concentrically symmetric connector are circularly symmetric along a center axis of the connector; and wherein the fans are arranged in a staggered arrangement.

2. The system of claim 1, wherein the concentrically symmetric connector is an audio plug.

3. The system of claim 1, wherein the concentrically symmetric connector is an audio jack.

4. The system of claim 1, wherein the round fan assembly further comprises a grill configured to prevent finger intrusion to a fan blade.

5. The system of claim 4, wherein the round fan assembly further comprises an electromagnetic interference (EMI) gasket on a circumference of each circular fan configured to create an EMI boundary.

6. The system of claim 1, wherein each round fan assembly further comprises a latching mechanism wholly contained within a swept area of a fan blade.

7. The system of claim 6, wherein one or more latch pieces of the latching mechanism are perforated to reduce impedance to airflow of the fan blade.

8. The system of claim 1, wherein the staggered arrangement of circular fans increases a swept area of a chassis area compared to a non-staggered arrangement.

9. The system of claim 1, wherein the staggered arrangement of circular fans increases a number of circular fans that can be placed in the fan assembly system compared to a non-staggered arrangement.

10. A method of packaging a cooling fan assembly, comprising:

inserting a round fan assembly into one of one or more round openings of an enclosure, wherein the round openings are arranged in a staggered arrangement; and applying insertion force to mate a concentrically symmetric connector at a center of the round fan assembly.

11. The method of claim 10, further comprising:

mating the concentrically symmetric connector with an audio plug.

12. The method of claim 10, further comprising:

mating the concentrically symmetric connector with an audio jack.

13. The method of claim 10, further comprising:

latching the round fan assembly with a latching mechanism wholly contained within a swept area of a fan blade.

14. The method of claim 13, wherein one or more latch pieces of the latching mechanism are perforated to reduce impedance to air flow of the fan blade.

15. The method of claim 10, wherein the staggered arrangement of circular fans increases a swept area of a chassis area compared to a non-staggered arrangement.

16. The method of claim 10, wherein inserting the round fan assembly comprises inserting the round fan assembly in any orientation.

17. A fan assembly system, comprising:

two or more circular fans, each fan situated in a round fan assembly, wherein each fan can be situated in the round fan assembly in any orientation;

a concentrically symmetric connector for each circular fan, wherein the concentrically symmetric connector is located in a center of each circular fan, wherein a plurality of contacting surfaces of the concentrically symmetric connector are circularly symmetric along a center axis of the connector;

a latching mechanism for each circular fan, wherein the latching mechanism is wholly contained within a swept area of a fan blade of the circular fan; and wherein the circular fans are arranged in a staggered arrangement, and the staggered arrangement of circular fans increases a number of circular fans that can be placed in the fan assembly system compared to a non-staggered arrangement.

18. The system of claim 17, wherein the concentrically symmetric connector is an audio plug.

19. The system of claim 17, wherein the concentrically symmetric connector is an audio jack.

20. The system of claim 17, wherein one or more latch pieces of the latching mechanism are perforated to reduce impedance to airflow of the fan blade.

* * * * *